US005704548A

United States Patent [19]

Hedger et al.

[11] Patent Number: 5,704,548

[45] Date of Patent: Jan. 6, 1998

[54] SPRAY NOZZLE HAVING AIR SHAPING ORIFICES AND REVERSING STRUCTURE FOR CLEANING

[75] Inventors: Thomas A. Hedger, Largo; Nicholas P. Chagaris, Tarpon Springs, both of Fla.

[73] Assignee: Graves Spray Supply, Inc., Clearwater, Fla.

[21] Appl. No.: 641,499

[22] Filed: May 1, 1996

[51] Int. Cl.[6] ..... B05B 7/12

[52] U.S. Cl. ..... 239/119; 239/299; 239/306; 239/582.1; 239/416.1; 239/417.5; 239/422

[58] Field of Search ..... 239/119, 290, 239/294, 296, 299, 302, 366, 414, 416.4, 417.5, 422, 433, 582.1

[56] References Cited

U.S. PATENT DOCUMENTS

| | | | |
|---|---|---|---|
| 949,489 | 2/1910 | Mastin . | |
| 1,737,299 | 11/1929 | Cuel | 239/114 |
| 3,006,559 | 10/1961 | Schmidt | 239/240 X |
| 3,955,763 | 5/1976 | Pyle et al. . | |
| 4,116,386 | 9/1978 | Calder . | |
| 4,263,166 | 4/1981 | Adams | 239/414 X |
| 4,365,563 | 12/1982 | Wu | 239/119 X |
| 4,471,887 | 9/1984 | Decker | 239/414 X |
| 4,611,758 | 9/1986 | Geberth, Jr. . | |
| 4,618,098 | 10/1986 | Hedger, Jr. et al. | 239/296 X |
| 4,635,850 | 1/1987 | Leisi . | |
| 4,757,947 | 7/1988 | Calder . | |
| 4,830,281 | 5/1989 | Calder . | |
| 5,211,335 | 5/1993 | Strid . | |
| 5,255,848 | 10/1993 | Rhodehouse . | |
| 5,340,029 | 8/1994 | Adams . | |
| 5,379,939 | 1/1995 | Perret, Jr. . | |

FOREIGN PATENT DOCUMENTS

| | | | |
|---|---|---|---|
| 4190865 | 7/1992 | Japan | 239/119 |
| 1171107 | 8/1985 | U.S.S.R. | 239/290 |

*Primary Examiner*—Kevin Weldon

*Attorney, Agent, or Firm*—Larson & Larson, P.A.; James E. Larson

[57] ABSTRACT

A spray nozzle includes a central resin nozzle and peripheral catalyst nozzles as well as air nozzles designed to emit streams of air to shape the flow of the resin material from the resin nozzle. The resin nozzle is mounted on a rotary fitting allowing the direction of the resin nozzle to be reversed 180° to permit cleaning of the resin nozzle. The air nozzles consist of passageways through the rotary fitting that are aligned with respective sources of air pressure when the rotary fitting is positioned to permit spraying of resin through the resin nozzle.

19 Claims, 6 Drawing Sheets

SPRAY NOZZLE HAVING AIR SHAPING ORIFICES AND REVERSING STRUCTURE FOR CLEANING

BACKGROUND OF THE INVENTION

The present invention relates to a spray nozzle having air shaping nozzles and reversing structure for cleaning. The present invention comprises an improvement over the invention disclosed in U.S. Pat. No. 4,854,504 to Hedger, Jr. et al. The Hedger, Jr. et al. patent teaches a central resin nozzle, peripheral catalyst nozzles and air nozzles surrounding the resin nozzle to shape the flow of the resin from the resin nozzle. However, in order to clean the resin nozzle of the Hedger, Jr. et al. device, the nozzle must be disassembled. The present invention is specifically designed to overcome this deficiency in the Hedger, Jr. et al. device.

Over the course of the last decade or so, the fiberglass reinforced plastics industry has evolved in terms of the methods employed to spray polyester resins and gelcoats. Whereas air atomized systems were commonplace a decade ago, evolution to airless or hydraulic atomization and, more recently, to airless air assist atomization has occurred.

As is known, air atomized systems typically create the highest amount of overspray thus resulting in extremely low transfer efficiency of the material being sprayed. Overspray was reduced through the use of the airless or hydraulic atomization systems. However, such systems require the use of very high pressures to atomize the polyester material as well as fairly small orifice sizes, in the range of 0.013 up to 0.070 inches. In such systems, the spray angle typically ranges from 10° to 100° depending upon the particular application and the airless spray pressures normally lie within the range of 400 psi to 2500 psi. With such small orifice sizes being employed, contamination, including dirt, in the sprayed material often causes the spray nozzles to become clogged. While in-line strainers have reduced clogging, when strainers become too fine, they begin to effect the pressure output of the nozzle. Thus, strainers do not completely eliminate clogging.

The industry has recently turned to the airless air assist atomization devices that allow the material to be atomized at significantly lower spray pressures. The use of shaping air jets assists atomization and contains fly away or overspray. As a result, through the use of such systems, the resulting spray pattern is uniform, well atomized, and more transfer efficient. The airless air assist system is also advantageous since the resin and catalyst are mixed externally of the nozzle.

Problems still exist when employing the airless air assist system. In particular, such a system still requires the use of extremely small diameter elliptically shaped orifices. Thus, the problem of contamination of the sprayed material still exists and still results in clogging of the nozzle. The time spent cleaning the nozzle creates a loss of productivity and also requires additional cleaning tools. A spray nozzle such as that which is used in an airless air assist system has a precision orifice and angle machined into it, and it is easy to damage the nozzle so as to render it unusable for its intended purpose. The present invention was developed in order to avoid these deficiencies.

The following prior art is known to Applicant:

U.S. Pat. No. 949,489 to Mastin

U.S. Pat. No. 3,955,763 to Pyle et al.

U.S. Pat. No. 4,116,386 to Calder

U.S. Pat. No. 4,611,758 to Geberth, Jr.

U.S. Pat. No. 4,635,850 to Leisi

U.S. Pat. No. 4,757,947 to Calder

U.S. Pat. No. 4,830,281 to Calder

U.S. Pat. No. 5,211,335 to Strid

U.S. Pat. No. 5,255,848 to Rhodehouse

U.S. Pat. No. 5,340,029 to Adams

U.S. Pat. No. 5,379,939 to Perret, Jr.

The present invention differs from the teachings of these references as contemplating locating the resin nozzle on a rotary fitting that may be rotated 180° to allow reverse flow to clean the nozzle, the same rotary fitting carrying passageways therethrough comprising the air assist nozzles themselves.

SUMMARY OF THE INVENTION

The present invention relates to a spray nozzle having air shaping nozzles and reversing structure for cleaning. The present invention includes the following interrelated objects, aspects and features:

(1) In a first aspect, the inventive spray nozzle is of the type having a central resin nozzle, peripheral catalyst nozzles, and air assist shaping nozzles to either side of the resin nozzle.

(2) The nozzle is fitted to a spray gun that is coupled to sources of pressurized air, resin and catalyst. The spray gun has a suitable handle and actuator designed to be gripped by the user to allow activation and deactivation of flow through control of one or more valves.

(3) The inventive nozzle includes channels therethrough designed to convey catalyst, resin and air to the respective nozzles therefor.

(4) A rotary fitting is mounted on the forward end of the nozzle housing and carries the catalyst nozzle. The rotary fitting may be rotated 180° to reverse the direction of the resin nozzle so that flow can be conducted therethrough in the reverse direction to clean out any clog, including dirt or debris, quite efficiently. Additionally, the rotary fitting includes two passageways therethrough which comprise the air assist nozzles aligned with sources of air pressure when the resin nozzle is rotated through rotation of the rotary fitting to the operative position.

Accordingly, it is a first object of the present invention to provide a spray nozzle having air shaping nozzles and reversing structure for cleaning.

It is a further object of the present invention to provide such a device including a rotary fitting carrying a catalyst nozzle and whereby the rotary fitting may be rotated 180° to facilitate cleaning of the catalyst nozzle.

It is a yet further object of the present invention to provide such a device wherein the rotary fitting also carries air assist nozzles conveying pressurized air therethrough to shape the outward flow of catalyst from the catalyst nozzle.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
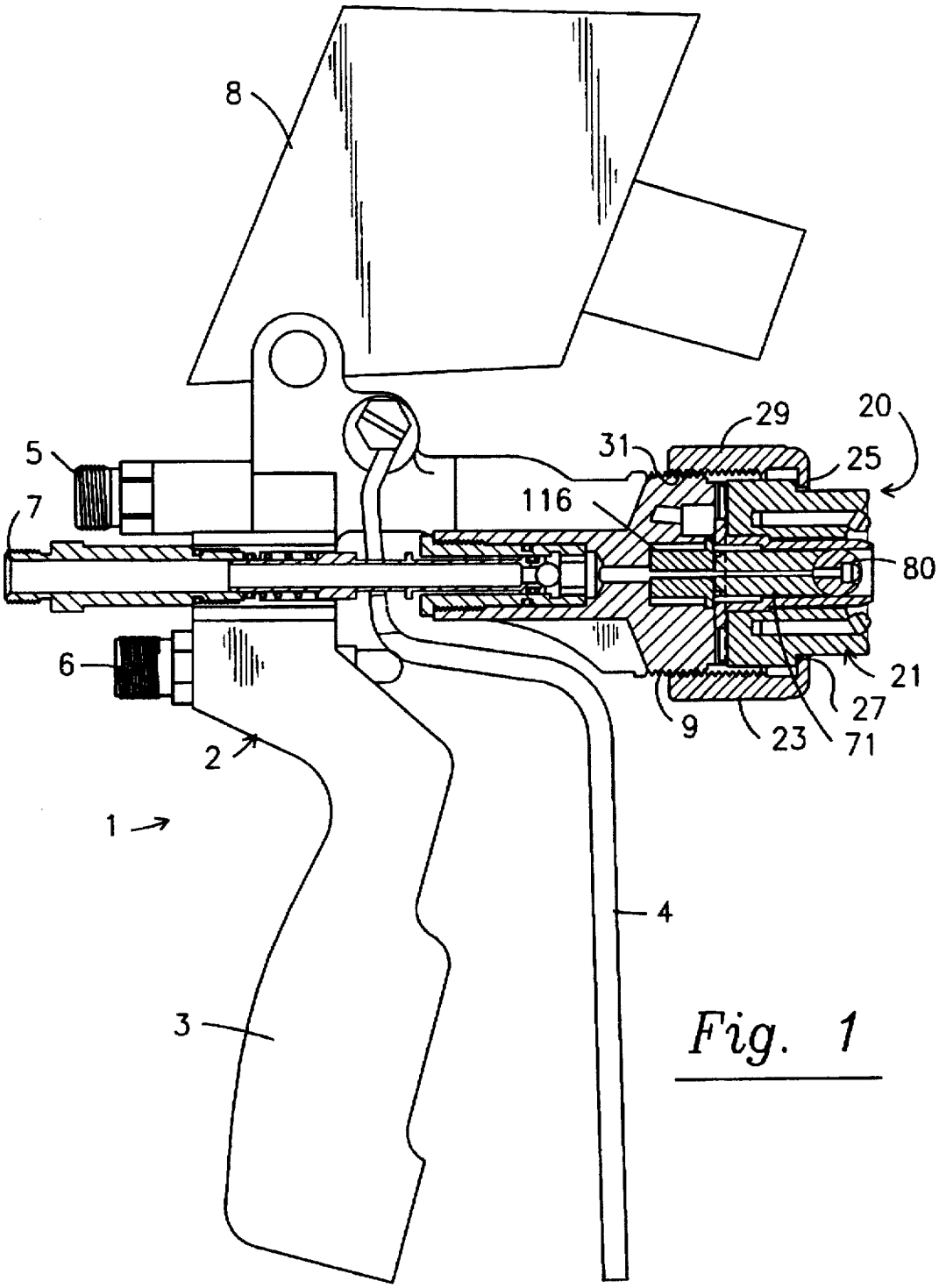
FIG. 1 shows a side view, partially in cross-section, of a spray gun having the inventive nozzle attached thereto.

With reference, first, to FIG. 1, a spray gun is generally designated by the reference numeral 1 and is seen to include a body 2 having a handle 3 and an actuator 4. The body 2 has fittings 5, 6 and 7 designed to allow fluidly connecting the spray gun 1 to sources of pressurized catalyst resin and air. The spray gun also includes a chopper body 8 designed to deliver a volume of chopped fiberglass which may, in a manner well known to those skilled in the art, be dispensed over a stream of sprayed resin.

The inventive nozzle is generally designated by the reference numeral 20 and is seen to include a nozzle body 21 as well as a locking ring 23 having an inwardly directed portion 25 designed to sit on a shoulder 27 formed on the nozzle body 21 and having a generally cylindrical portion 29 with internal threads 31 designed to enmesh with external threads 9 formed on the nozzle body 2. The locking ring 23 appropriately locks the nozzle body 21 on the spray gun body 2 as is clearly seen in FIG. 1.

Figure 2:
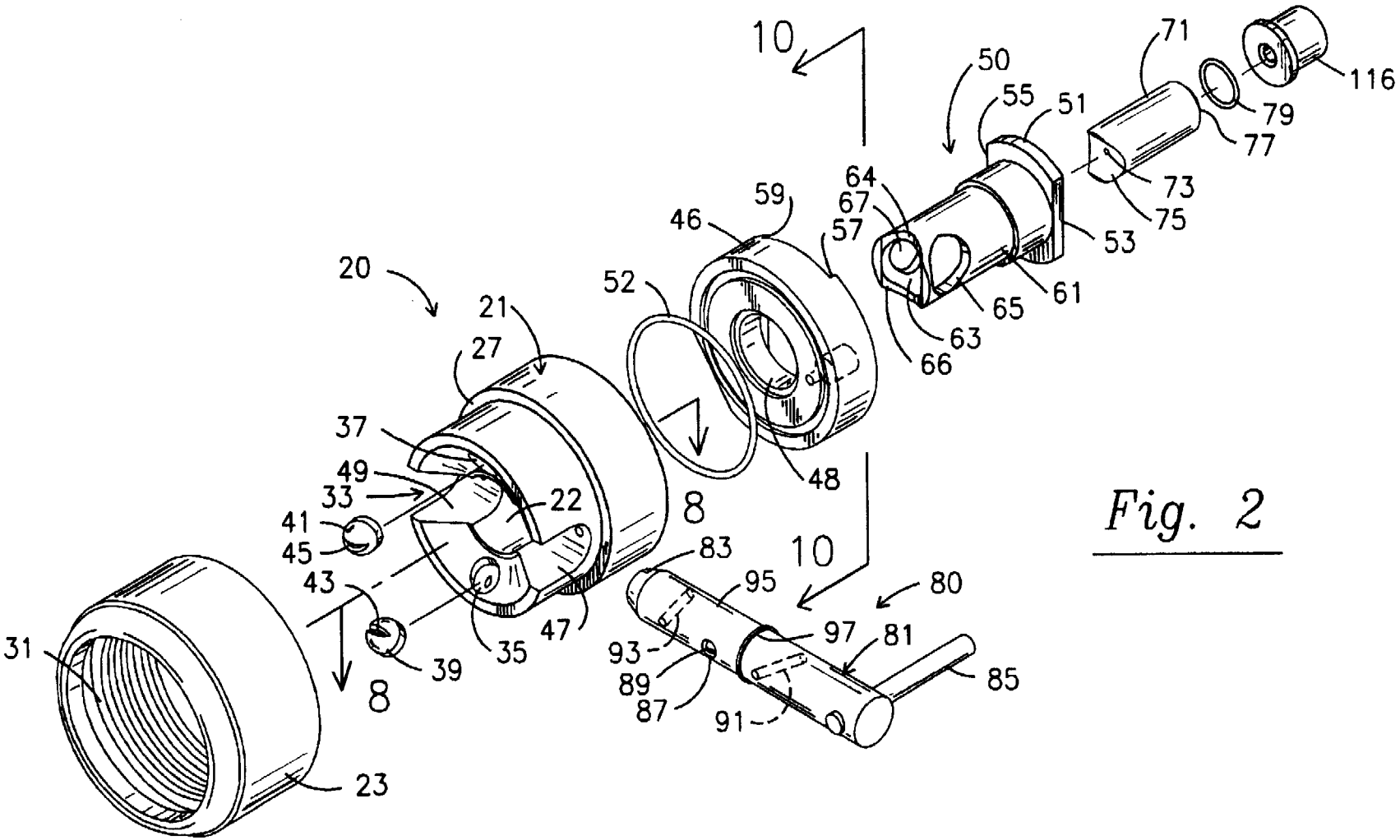
FIG. 2 shows an exploded perspective view of the inventive nozzle.

FIG. 2 shows the various components of the inventive nozzle in exploded perspective view. As shown, the nozzle body 21 has a forward end 33 with recesses 35 and 37 therein sized to receive catalyst nozzles 39 and 41 therein. As seen in FIG. 2, the catalyst nozzles 39 and 41 have respective orifices 43 and 45 of elliptical configuration. The forward end 33 of the nozzle body 21 also includes two opposed but aligned U-shaped slots 47 and 49 for a purpose to be described in greater detail hereinafter.

At the rear of the body 21, a fitting 46 is coupled thereto with a seal 52 to prevent leakage.

As also shown in FIG. 2, a nozzle retainer 50 includes a rear portion 51 having side walls 53 and 55 designed to be captured between the rear walls 57 and 59 of the fitting 46 to properly align the nozzle retainer 50 in the orientation shown in FIG. 2 when the nozzle retainer 50 is extended through the opening 48 of the fitting 46. The nozzle retainer 50 also includes a tubular portion 61 having a central passageway 63 therethrough along with lateral openings 65 and 67 designed to align with the slots 47 and 49 when the nozzle retainer 50 is inserted through the passageway 22 of the body 21. The nozzle retainer 50 also includes a forward end having recesses 64 and 66 that are provided so that the nozzle retainer 50 does not interfere with the spray pattern of catalyst emanating from the nozzles 39 and 41.

A seal 71 is slidably received through the passageway 63 in the nozzle retainer 50 and includes an orifice 73 therethrough that opens into a concave forward surface 75 for a purpose to be described in greater detail hereinafter. At the rear portion 77 of the seal 71, an O-ring 79 is provided to prevent leakage. In the preferred embodiment of the present invention, the seal 71 is made of a material such as, for example, ultra high molecular weight polyethylene otherwise known by the designation "UHMWPE". Retainer 116 holds the seal in place.

Figure 3:
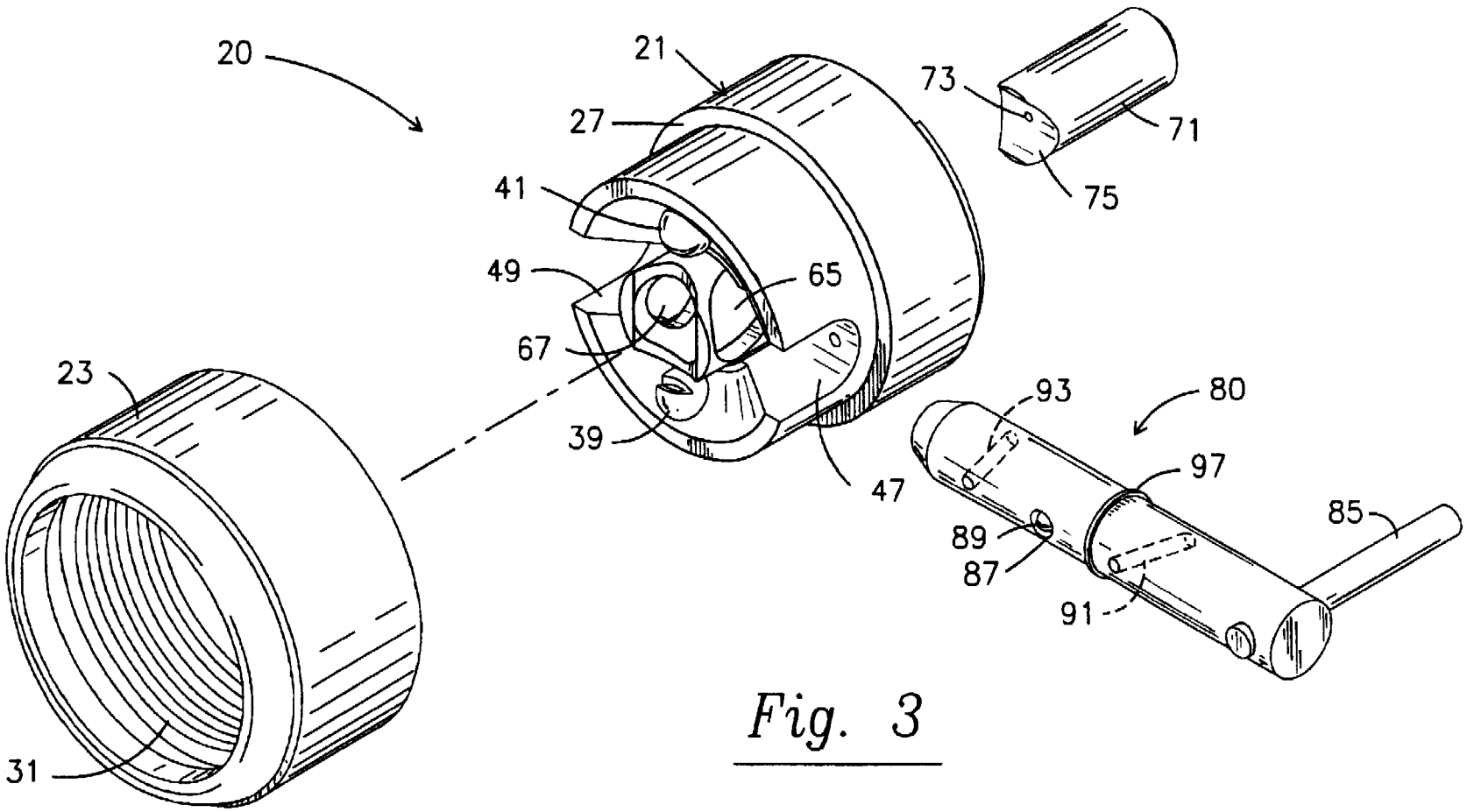
FIG. 3 shows an exploded perspective view of pertinent portions of the inventive nozzle.
Figure 4:
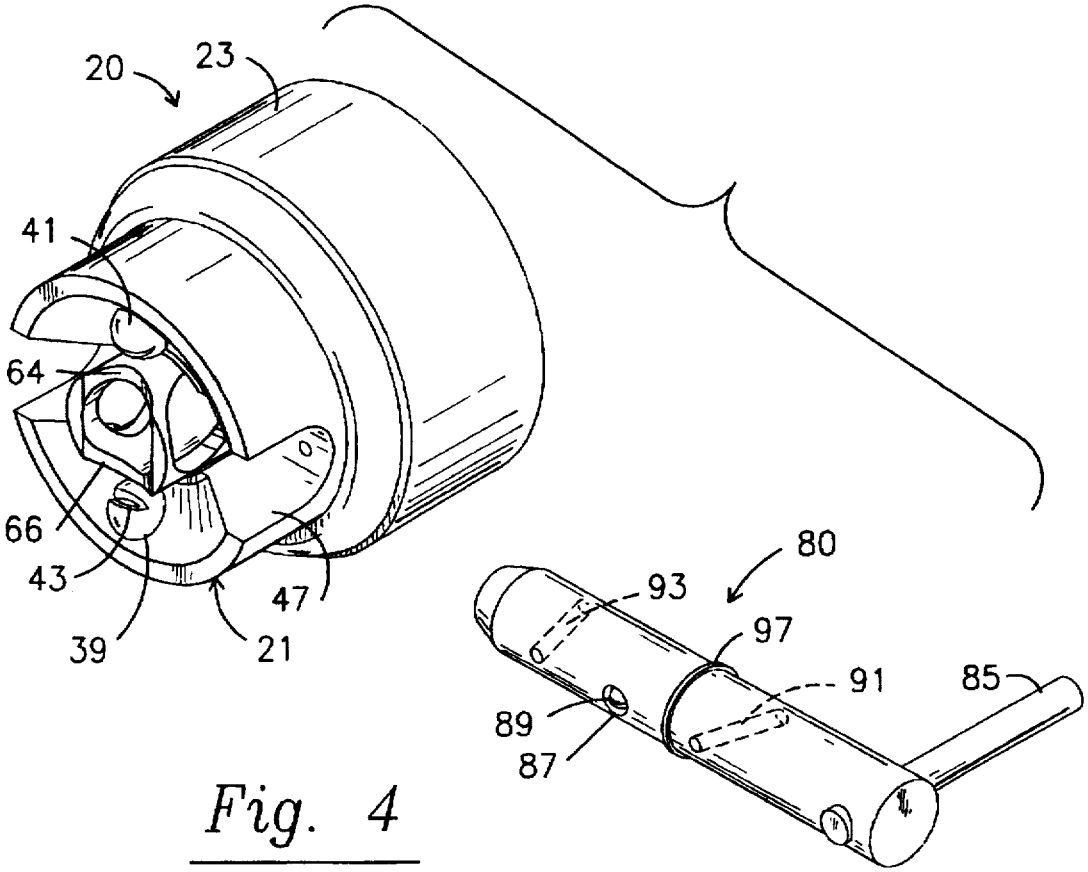
FIG. 4 shows an exploded perspective view of the nozzle body and rotary fitting of the present invention disassembled from one another.
Figure 5:
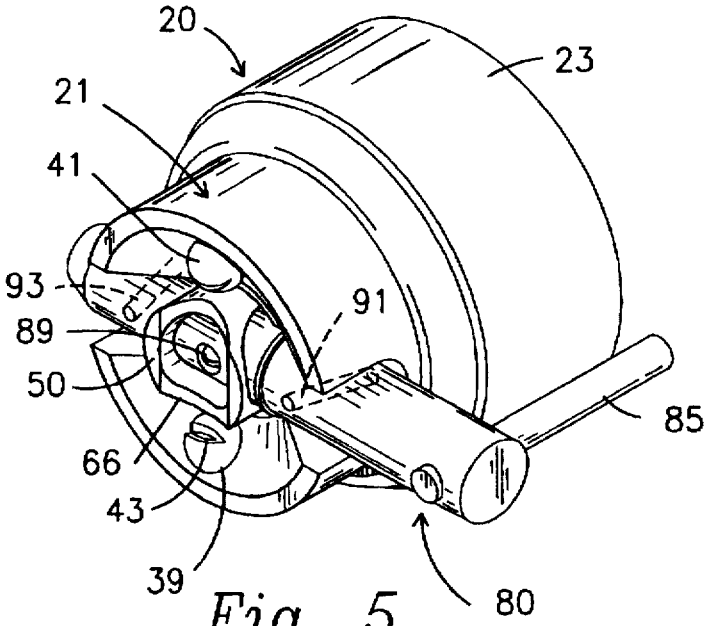
FIG. 5 shows a view similar to that of FIG. 4 but with the nozzle body and rotary fitting assembled together.

A rotary fitting 80 has a generally cylindrical body 81 having a rounded end 83 and, at the other end, an actuating handle 85. A central orifice or narrow conduit 87 receives a resin nozzle 89 having a generally elliptical configuration. Additional passageways or narrow conduits 91 and 93 are provided through the rotary fitting 80 for a purpose to be described in greater detail hereinafter. As should be understood from FIGS. 3, 4 and 5, when the nozzle retainer 50 is received within the passageway 22 of the body 21, the rotary fitting 80 extends through the U-shaped slot 47, through the opening 65, through the opening 67, and thence through the U-shaped slot 49. The concave surface 75 of the seal 71 engages a side face 95 of the rotary fitting 80 with the orifice 73 of the seal 71 aligning with the passageway 87 through the rotary fitting 80 in either of two orientations thereof as will be described in greater detail hereinafter. The rotary fitting 80 includes a radially outwardly extending stop shoulder 97 that bears against the surfaces surrounding the opening 65 of the nozzle retainer 50 when the inventive device 20 is assembled together to limit the inward movement of the rotary fitting 80 and thereby define the positions of alignment of the respective passageways 91, 87 and 93.

Figure 8:
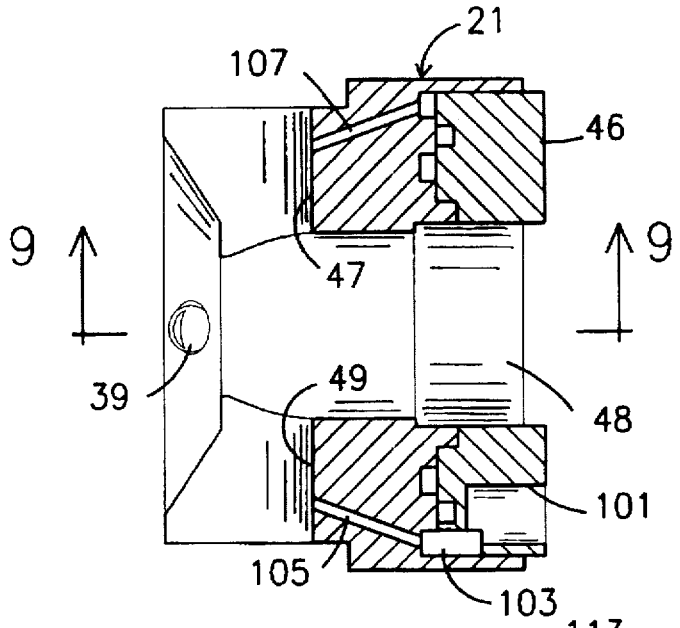
FIG. 8 shows a cross-sectional view along the line 8—8 of FIG. 2.

With reference to FIG. 8, it is seen that the fitting 46 has a rear chamber 101 connected to a source (not shown) of air pressure. The annular passageway 103 connects to passageways 105 and 107 which, with reference to FIG. 6, supply the respective passageways 91 and 93 through the fitting 80 when the fitting 80 is in the orientation shown in FIG. 6.

Figure 9:
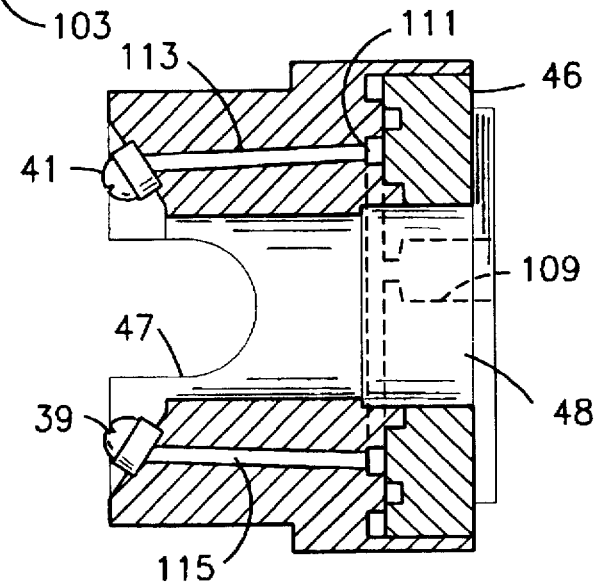
FIG. 9 shows a cross-sectional view along the line 9—9 of FIG. 8.
Figure 10:
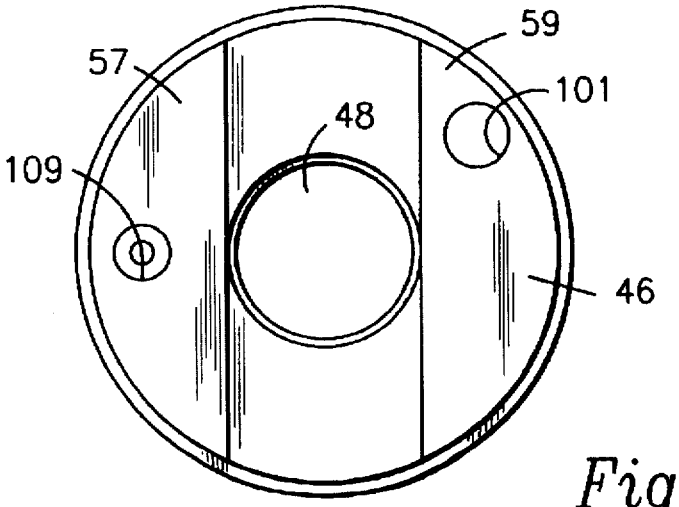
FIG. 10 shows a rear view along the line 10—10 of FIG. 2.

With reference to FIG. 9, it is seen that the fitting 46 includes a rear chamber shown in phantom and designated by the reference numeral 109 that is connected to a source of liquid catalyst. The chamber 109 is fluidly connected to the annulus 111 that feeds the passageways 113 and 115 that supply liquid catalyst to the nozzles 39 and 41.

Figure 7:
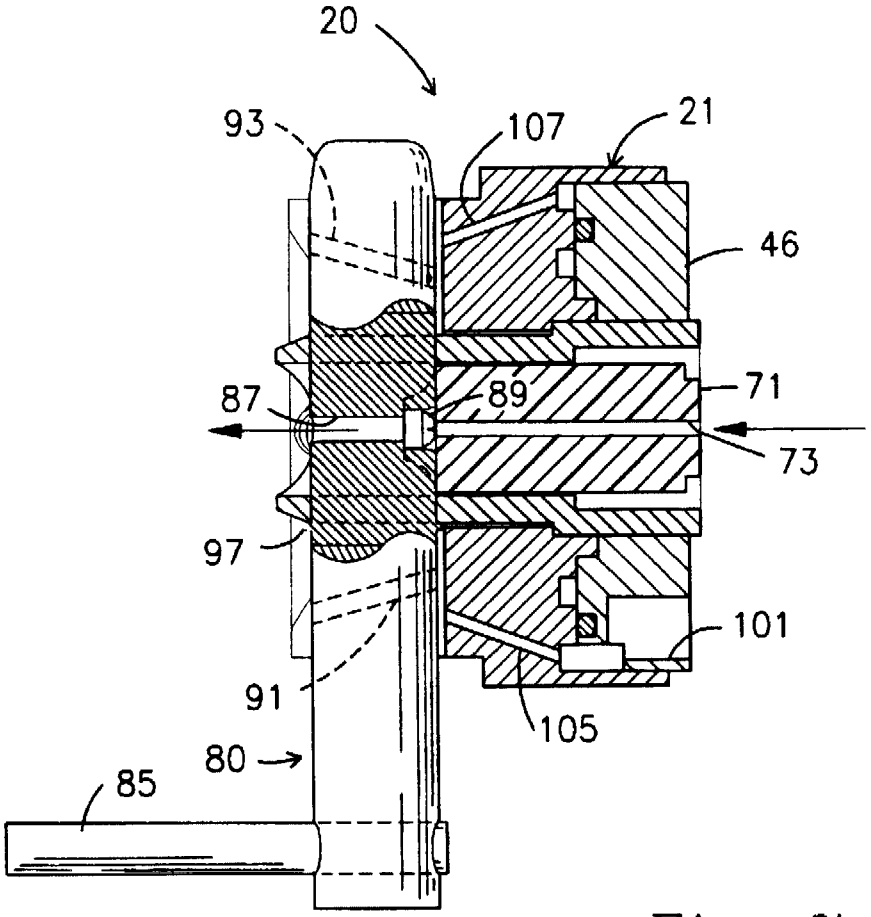
FIG. 7 shows a cross-sectional view through the nozzle body with the rotary fitting rotated 180° with respect to its orientation in FIG. 6.
Figure 6:
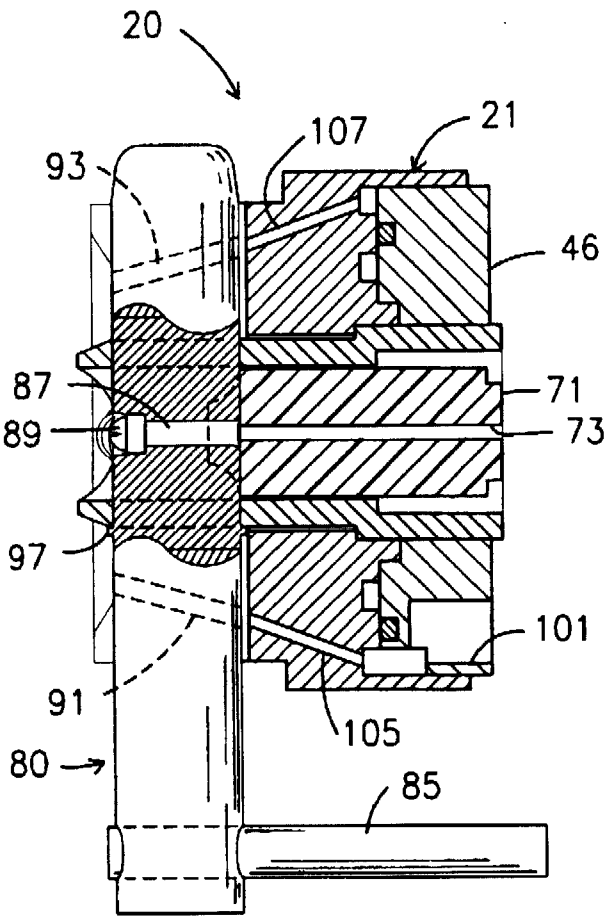
FIG. 6 shows a cross-sectional view through the nozzle body with the rotary fitting thereof in a first orientation.

With references to FIGS. 6 and 7, the central passageway 73 through the seal 71 is connected to a source of liquid resin and supplies the passageway 87 and the nozzle 89 within the rotary fitting 80 in the positions shown in FIGS. 6 and 7.

With the present invention having been described in conjunction with appropriate reference to FIGS. 1–10, the operation of the invention will now be explained. With the chamber 101 fluidly connected to a source of pressurized air (not shown) through the spray gun 1, with the chamber 109 connected to a source of liquid catalyst (not shown) through the spray gun 1 and with the passageway 73 connected to a source of liquid resin (not shown) through the spray gun 1, the rotary fitting 80 is inserted into the body 21 and is rotated to the position and orientation best seen in FIG. 6. In this position, the nozzle 89 faces in the forward facing direction and the respective passageways 91 and 93 in the fitting 80 are aligned with the passageways 105 and 107 in the nozzle body 21. In this orientation, the spray gun 1 may be actuated in a manner well known to those skilled in the art to supply resin sprayed through the nozzle 89, which resin is shaped by air flowing through the passageways 91 and 93 and is mixed with catalyst flowing through the nozzles 39 and 41.

Should a piece of dirt or other contaminant clog the nozzle 89, the spray gun 1 is operated in an appropriate manner to stop the flow of catalyst, resin and air. Thereafter, the rotary fitting 80 is rotated 180° to the position shown in FIG. 7 with the nozzle 89 now facing directly toward the passageway 73 in a rearward facing direction. In this position, the spray gun 1 is actuated to cause liquid resin to flow through the passageway 73 and thence in the backward direction through the nozzle 89 and thence through the passageway 87 to thereby backflush the nozzle 89 and remove any dirt or contaminants therefrom. The reverse flowing resin is removed and discarded and the rotary fitting 80 is rotated back to the position shown in FIG. 6 whereupon spraying operations may be started anew.

As should be understood by those skilled in the art, when the nozzle body 21 is assembled to the spray gun 1, the concave forward end 75 of the seal 71 bears against the surface 95 of the rotary fitting 80 in a frictional interengagement that retains the position of the rotary fitting 80 in the position to which it has been rotated by the user. When it is desired to rotate the fitting 80 between the positions shown in FIGS. 6 and 7, such rotation is made against the frictional forces between the surface 75 of the seal 71 and the surface 95 of the rotary fitting 80.

In the preferred embodiment of the present invention, the nozzle body 21 and rear fitting 46 as well as the rotary fitting 80 are made of any suitable metal such as stainless steel or iron alloys. As explained above, the seal 71 is preferably made of ultra high molecular weight polyethylene.

As such, an invention has been disclosed in terms of a preferred embodiment thereof which fulfills each and every one of the objects of the invention as set forth hereinabove and provides a new and useful spray nozzle having air shaping nozzles and reversing structure for cleaning of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A spray nozzle, comprising:

a) a body having a first passageway connectable to a first source of fluid and a second passageway connectable to a second source of fluid;

b) a rotary fitting rotatably received in said body and carrying first and second nozzles;

c) said rotary fitting being rotatable between first and second orientations, whereby in said first orientation, said first nozzle is aligned with said first passageway in a forward facing direction of said first nozzle and said second nozzle is aligned with said second passageway, and whereby, in said second orientation, said first nozzle is aligned with said first passageway in a rearward facing direction of said first nozzle to facilitate back-flushing of said first nozzle.

2. The spray nozzle of claim 1, wherein said rotary fitting has a stop shoulder engaging a surface on said body to align said nozzles and their respective passageways.

3. The spray nozzle of claim 1, wherein said rotary fitting is generally cylindrical.

4. The spray nozzle of claim 1, further including a third passageway in said body and a third nozzle in said fitting alignable with said third passageway in said first orientation.

5. The spray nozzle of claim 4, wherein said second passageway is connectable to a source of pressurized air.

6. The spray nozzle of claim 5, wherein said third passageway is connectable to said source of pressurized air.

7. The spray nozzle of claim 5, wherein said first passageway is connectable to a source of liquid resin.

8. The spray nozzle of claim 7, further including a fourth passageway in said body connectable to a source of liquid catalyst and a fourth nozzle in said body fluidly coupled to said fourth passageway.

9. The spray nozzle of claim 1, wherein said first nozzle is fluidly connectable to said first passageway, in said first orientation, by a narrow conduit in said fitting.

10. The spray nozzle of claim 9, wherein said second nozzle comprises a further narrow conduit extending through said fitting.

11. The spray nozzle of claim 1, wherein said fitting includes a handle.

12. The spray nozzle of claim 1, further wherein in said second orientation, said second nozzle is misaligned with respect to said second passageway.

13. The spray nozzle of claim 1, further including a retainer ring adapted to couple said spray nozzle to a spray gun.

14. A spray nozzle attachable to a spray gun and comprising:

a) a body having a first passageway connectable to a source of liquid resin and a second passageway connectable to a source of pressurized air;

b) a rotary fitting rotatably received in said body and carrying first and second nozzles, said second nozzle comprising a narrow conduit through said rotary fitting;

c) said rotary fitting being rotatable between first and second orientations, whereby in said first orientation, said first nozzle is aligned with said first passageway in a forward facing direction of said first nozzle and said second nozzle is aligned with said second passageway, and whereby, in said second orientation, said first nozzle is aligned with said first passageway in a rearward facing direction of said first nozzle to facilitate back-flushing of said first nozzle while said narrow conduit is misaligned with respect to said second passageway.

15. The spray nozzle of claim 14, wherein said rotary fitting has a stop shoulder engaging a surface on said body to align said nozzles and their respective passageways.

16. The spray nozzle of claim 14, further including a third passageway in said body connectable to a source of liquid catalyst and a third nozzle in said body fluidly coupled to said third passageway.

17. The spray nozzle of claim 14, wherein said first nozzle is fluidly connectable to said first passageway, in said first orientation, by a further narrow conduit in said rotary fitting.

18. The spray nozzle of claim 14, wherein said rotary fitting includes a handle.

19. The spray nozzle of claim 14, further including a retainer ring adapted to couple said spray nozzle to a spray gun.

* * * * *